US010822951B2

(12) United States Patent
Hazel et al.

(10) Patent No.: US 10,822,951 B2
(45) Date of Patent: Nov. 3, 2020

(54) SUSPENSION PLASMA SPRAY ABRADABLE COATING FOR CANTILEVER STATOR

(71) Applicant: United Technologies Corporation, Farmington, CT (US)

(72) Inventors: Brian T. Hazel, Avon, CT (US); Kevin W. Schlichting, South Glastonbury, CT (US); Michael J. Maloney, Marlborough, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 227 days.

(21) Appl. No.: 15/656,960

(22) Filed: Jul. 21, 2017

(65) Prior Publication Data

US 2019/0024510 A1 Jan. 24, 2019

(51) Int. Cl.

| | |
|---|---|
| ***F01D 5/02*** | (2006.01) |
| ***C23C 4/134*** | (2016.01) |
| ***C23C 4/129*** | (2016.01) |
| ***C23C 4/11*** | (2016.01) |
| ***F01D 25/00*** | (2006.01) |
| ***C23C 28/04*** | (2006.01) |

(52) U.S. Cl.

CPC ..... *F01D 5/02* (2013.01); *C23C 4/11* (2016.01); *C23C 4/129* (2016.01); *C23C 4/134* (2016.01); *C23C 28/042* (2013.01); *F01D 25/005* (2013.01); *F05D 2300/21* (2013.01); *F05D 2300/611* (2013.01)

(58) Field of Classification Search

None

See application file for complete search history.

(56) References Cited

U.S. PATENT DOCUMENTS

2004/0229031 A1* 11/2004 Gell ..... B82Y 30/00 428/323
2013/0071235 A1* 3/2013 Strock ..... F01D 11/122 415/174.4
2015/0044444 A1* 2/2015 Gell ..... C23C 4/10 428/220

(Continued)

OTHER PUBLICATIONS

Fan et al.; Microstructural design and properties of supersonic suspension plasma sprayed thermal barrier coatings; 2016, Journal of Alloys and Compounds; (699) pp. 763-774 (Year: 2016).*

(Continued)

*Primary Examiner* — David Sample
*Assistant Examiner* — Elizabeth Collister
(74) *Attorney, Agent, or Firm* — Cantor Colburn LLP

(57) ABSTRACT

Disclosed herein is a method comprising mixing a carrier liquid with particles and/or with a particle precursor to form a suspension or solution respectively; where the particles comprise a metal oxide; and where the particle precursor comprises a metal salt; injecting the suspension or solution through a plasma flame; and depositing the particles and/or the particle precursor onto a substrate to form an first abradable coating; where the first abradable coating comprises a plurality of cracks or voids that are substantially perpendicular to the substrate surface, where the substrate is a hub surface of a gas turbine engine or where the substrate is a cantilever stator.

6 Claims, 3 Drawing Sheets

(56) References Cited

U.S. PATENT DOCUMENTS

2017/0152753 A1 6/2017 Serra et al.

OTHER PUBLICATIONS

Extended European Search Report for EP Application No. 18185030.6; Report dated Oct. 15, 2018 (11 pages).

Gell et al.; "Thermal Barrier Coatings Made by the Solution Precursor Plasma Spray Process"; Journal of Thermal Spray Technology, vol. 17, No. 1; Mar. 2008, pp. 124-135.

* cited by examiner

SUSPENSION PLASMA SPRAY ABRADABLE COATING FOR CANTILEVER STATOR

BACKGROUND

The present disclosure relates to a gas turbine engine and, more particularly, to a seal system therefor.

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor and turbine sections typically include stages that include rotating airfoils interspersed between fixed vanes of a stator assembly.

In gas turbine engines, it is generally desirable for efficient operation to maintain minimum rotor tip clearances, with a substantially constant clearance around the circumference. This is typical for cantilevered stators in an axial compressor. This may be difficult to achieve due to various asymmetric effects either on build or during running.

Typically, an abradable coating is used to coat the rotor lands of cantilever stators to accommodate the various asymmetric effects. Although effective, the abradable coatings may show increased levels of premature spallation over prolonged operations. It is therefore desirable to provide abradable coatings that minimize premature spallation and reduce the amount of maintenance desired on the gas turbine engine.

SUMMARY

Disclosed herein is a method comprising mixing a carrier liquid with particles and/or with a particle precursor to form a suspension or solution respectively; where the particles comprise a metal oxide; and where the particle precursor comprises a metal salt; injecting the suspension or solution through a plasma flame; and depositing the particles and/or the particle precursor onto a substrate to form an first abradable coating; where the first abradable coating comprises a plurality of cracks or voids that are substantially perpendicular to the substrate surface, where the substrate is a hub surface of a gas turbine engine or where the substrate is a cantilever stator.

In an embodiment, the method further comprises atomizing the suspension and/or the solution during the injection.

In yet another embodiment, the metal oxide comprises a silicate, zirconia, hafnia/hafnate, titania, alumina, a zirconate, a titanate, an aluminate, a stannate, a niobate, a tantalate, a tungstate, rare earth oxides, or a combination thereof.

In yet another embodiment, the metal oxide comprises perovskites; compounds with an orthorhombic crystal structure; Zr—Ta—Y ternary systems having cubic, fluorite or orthorhombic crystal structures; zirconate or hafnate based ceramic compounds that have a cubic or tetragonal or tetragonal prime crystal structure; yttria stabilized zirconia (YSZ); cubic zirconia; mono- and di-silicates with ytterbia or yttria as the anion; $YbSiO_5$; $Yb_2Si_2O_7$; $Y_2SiO_5$; $Y_2Si_2O_7$; $HfSiO_4$; partially or fully stabilized zirconia or hafnia; zirconia stabilized with yttria, calcia, magnesia, ceria, scandia and lanthanide series elements; hafnia or alumina-stabilized zirconia; fully stabilized zirconia including yttria-stabilized zirconia containing 20 wt % yttria; $Gd_2Zr_2O_7$ fully stabilized zirconia, fully stabilized zirconia containing 8 mole percent yttria, cubic stabilized zirconia, yttria stabilized zirconia having 4 to 9 mole percent yttria; or a combination thereof.

In yet another embodiment, the method further comprises disposing a second abradable coating onto the first abradable coating to form a multilayered coating, where the second abradable coating has a different composition from the first abradable coating.

In an embodiment, the particle precursor comprises aluminum and zirconium salts.

In yet another embodiment, the carrier liquid is a polar solvent or a non-polar solvent.

In yet another embodiment, the carrier liquid is water, propylene carbonate, ethylene carbonate, butyrolactone, acetonitrile, benzonitrile, nitromethane, nitrobenzene, sulfolane, dimethylformamide, N-methylpyrrolidone, an alcohol acetonitrile, nitromethane, benzene, toluene, methylene chloride, carbon tetrachloride, hexane, diethyl ether, tetrahydrofuran, or a combination thereof.

In yet another embodiment, the carrier liquid is ethanol.

In yet another embodiment, the first abradable coating comprises multiple layers.

In yet another embodiment, the first abradable coating comprises a gradient in composition.

In yet another embodiment, the first abradable coating comprises at least one of a partially stabilized zirconia and a cubic zirconia or alternatively comprises an alumina-zirconia.

Disclosed herein too is a first abradable coating disposed on a hub surface of a gas turbine engine, the abradable coating comprising a metal oxide; where the first abradable coating comprises a plurality of cracks or voids that are substantially perpendicular to the hub surface or to a free surface of the coating, where the plurality of cracks or voids define a plurality of columns having a width of 20 to 300 micrometers and a gap width of 1 to 30 micrometers, as measured 125 microns above an interface with the hub surface.

In an embodiment, the first abradable coating has an adhesive bond strength of greater than 2000 psi when measured as per ASTM C633.

In an embodiment, the first abradable coating has an adhesive bond strength of greater than 4000 psi when measured as per ASTM C633.

In an embodiment, the metal oxide comprises a silicate, zirconia, hafnium/hafnate, titania, alumina, a zirconate, a titanate, an aluminate, a stannate, a niobate, a tantalate, a tungstate, rare earth oxides, or a combination thereof.

In an embodiment, the metal oxide comprises perovskites; compounds with an orthorhombic crystal structure; Zr—Ta—Y ternary systems having cubic, fluorite or orthorhombic crystal structures; zirconate or hafnate based ceramic compounds that have a cubic or tetragonal or tetragonal prime crystal structure; yttria stabilized zirconia (YSZ); cubic zirconia; mono- and di-silicates with ytterbia or yttria as the anion; $YbSiO_5$; $Yb_2Si_2O_7$; $Y_2SiO_5$; $Y_2Si_2O_7$; $HfSiO_4$; partially or fully stabilized zirconia or hafnia; zirconia stabilized with yttria, calcia, magnesia, ceria, scandia and lanthanide series elements; hafnia or alumina-stabilized zirconia; fully stabilized zirconia including yttria-stabilized zirconia containing 20 wt % yttria; $Gd_2Zr_2O_7$ fully stabilized zirconia, fully stabilized zirconia containing 8 mole percent yttria, cubic stabilized zirconia, yttria stabilized zirconia having 4 to 9 mole percent yttria; or a combination thereof.

In yet another embodiment, the first abradable coating comprises one of a partially stabilized zirconia and a cubic zirconia.

In yet another embodiment, the first abradable coating comprises alumina-zirconia.

In yet another embodiment, the abradable coating further comprises a second abradable coating disposed on the first abradable coating, where the first abradable coating has a different composition from the second abradable coating.

The foregoing features and elements may be combined in various combinations without exclusivity, unless expressly indicated otherwise. These features and elements as well as the operation of the invention will become more apparent in light of the following description and the accompanying drawings. It should be appreciated, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
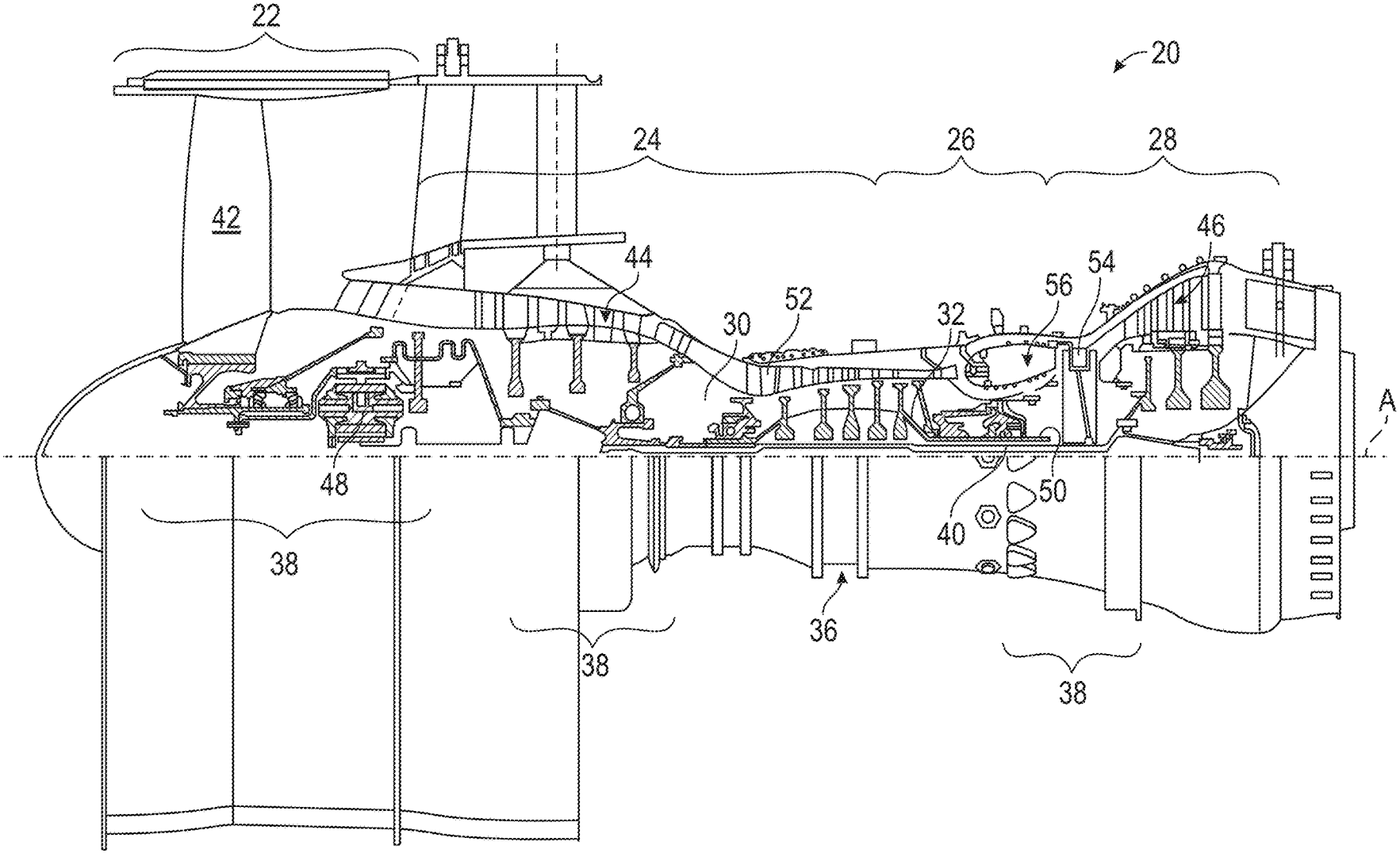
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be appreciated that the concepts described herein are not limited only thereto.

The engine 20 generally includes a low spool 30 and a high spool 32 mounted for rotation around an engine central longitudinal axis A relative to an engine static structure 36 via several bearing compartments 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or through a geared architecture 48 to drive the fan 42 at a lower speed than the low spool 30. An exemplary reduction transmission is an epicyclic transmission, namely a planetary or star gear system. The high spool 32 includes an outer shaft 50 that interconnects a high pressure compressor 52 ("HPC") and high pressure turbine 54 ("HPT"). A combustor 56 is arranged between the HPC 52 and the HPT 54. The inner shaft 40 and the outer shaft 50 are concentric and rotate around the engine central longitudinal axis A which is collinear with their longitudinal axes.

Core airflow is compressed by the LPC 44 then the HPC 52, mixed with fuel and burned in the combustor 56, then expanded over the HPT 54 and the LPT 46. The turbines 46, 54 rotationally drive the respective low spool 30 and high spool 32 in response to the expansion. The main engine shafts 40, 50 are supported at a plurality of points by the bearing compartments 38. It should be appreciated that various bearing compartments 38 at various locations may alternatively or additionally be provided.

Figure 2:
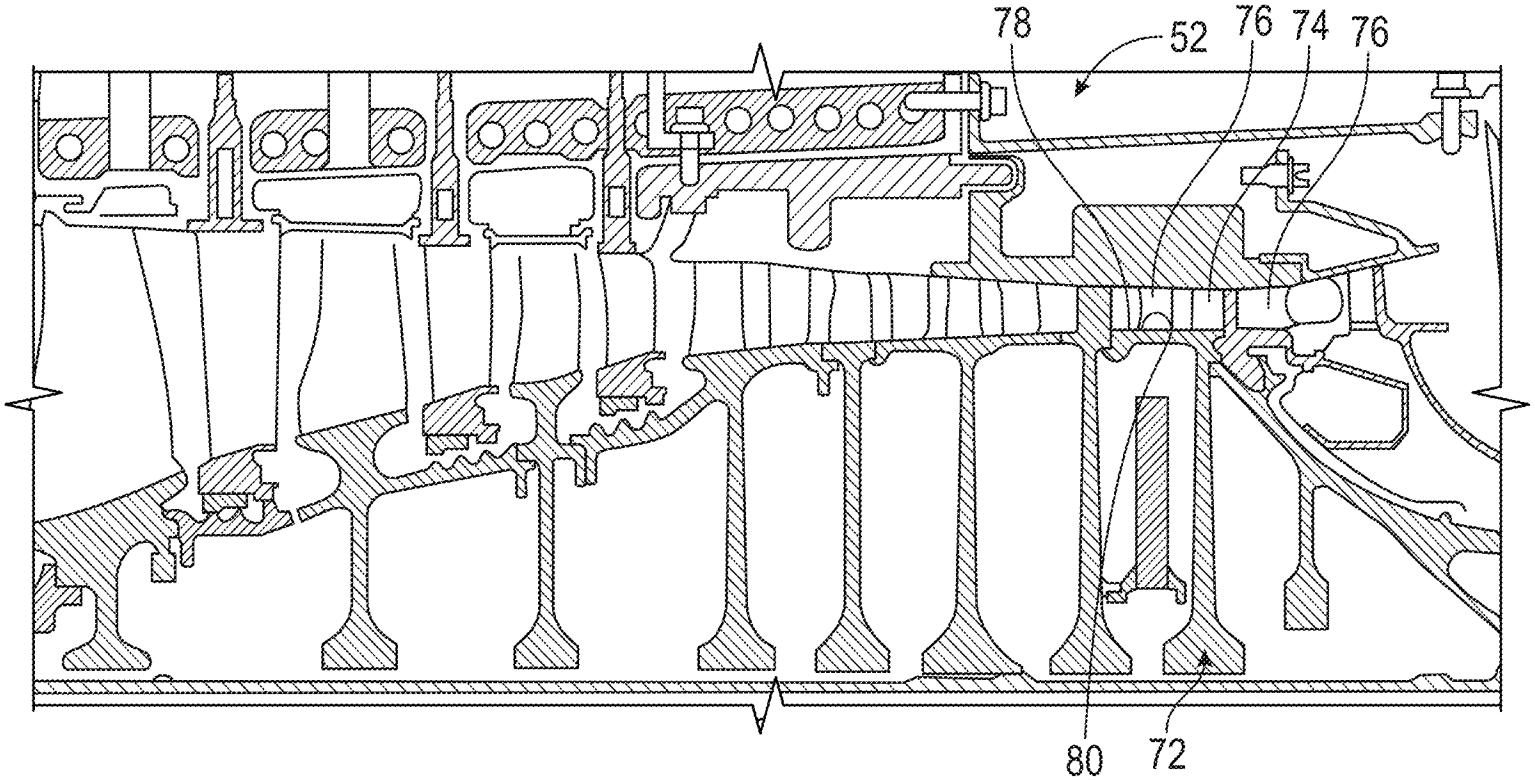
FIG. 2 is a longitudinal schematic sectional view of a compressor section of the gas turbine engine shown in FIG. 1.

With reference to FIG. 2, an exemplary HPC 52 includes a plurality of cantilevered stators 76. The rotor disk 72 includes an abradable section 80 on a hub surface 78 from which extend a plurality of blades 74 located axially downstream of the cantilevered stators 76. The abradable section 80 operates as an interface for a plurality of vanes of the cantilevered stator 76. During initial running of the engine 20, most, if not all, of the cantilevered stators 76 rub against the abradable section 80 to form an effective seal.

The current coatings for cantilever stators include a plasma spray coating that is generally characterized by an accumulation of splats separated by intersplat boundaries parallel to the surface upon which the coating is disposed. A splat is formed when a droplet of the coating material impacts the surface that it is intended to protect. As one splat is formed atop another on the surface, intersplat boundaries are formed between successive splats.

The current plasma spray coatings have a homogeneous distribution of larger pores throughout the coating along with the weak interfaces between respective splats, which results in a low to moderate ability to accommodate strain. When the strain capability of the coating is exceeded (either from thermal expansion, induced load from stator, or combination) the coating will delaminate by a "crack-jumping" mechanism whereby a crack occurs between pores and splat interfaces and propagates generally parallel to the substrate surface. The crack may propagate beyond the high strain zone due to the homogenous structure of the current coating and its lack of discreet separations perpendicular to the crack.

In order to overcome this problem, a coating structure is disclosed that alternatively provides a low modulus in a plane parallel to the substrate surface (not perpendicular like in the current coatings) while simultaneously being of a higher modulus in the other orientations (such as, for example, in a plane perpendicular to the substrate surface). This coating includes columns that are oriented perpendicular to the substrate and are separated from a neighboring column by either gaps or cracks. Level of separation and size of columns relate to the in-plane modulus (i.e., the modulus parallel to the plane of the substrate surface) which is generally low. This low modulus in a plane parallel the substrate surface means the coating will be more resilient to strain or from propagation of cracks formed due to the rub event with the stator. As a result, the disclosed columnar coating is more strain tolerant but is also more damage tolerant due to cracks having to jump from one column to the next.

In short, it is desirable for the coating to be a columnar coating with columns perpendicular to the substrate surface. This columnar coating can be produced by several processes. 1) Electron beam physical vapor deposition (EB-PVD) which builds columns of single crystals with defined gaps between columns. EB-PVD is expensive and utilizes a vacuum process and elevated temperature and is not conducive to coating large structures such as the hub surface 78 of rotor disk 72. 2) Vertically cracked air plasma spray coatings use a conventional air plasma spray method and material but with short standoff and higher coating temperatures to drive a quench crack vertically through the coating on cooling. The coating produced by this method has a higher density (typically less than 10% porosity) than the other current art but has a lower modulus in a plane parallel to substrate surface. The high density of the coating and higher density columns may not be ideal for abradable applications due to a higher level of rub energy/heat generated during a rub event. 3) SPS (suspension plasma spray) or SPPS (solution precursor plasma spray) utilize very fine particles in an air plasma spray method to build columns.

The current deposition mode understanding for SPS/SPPS is that fine particle motion in flight are directed by the plasma gas motion which means the particles will impinge on the substrate surface at angles less than normal (less than perpendicular to the substrate). This impingement angle drives a shadowing effect that forms columns from peaks in the surface and gaps/cracks that grow from the corresponding valleys. Due to the low momentum of the fine particles (because of their light weight), a liquid carrier provides the desirable additional momentum to get the fine particles into the plasma plume and projected toward the surface in the case of SPS. In SPPS, a liquid carrier provides the momentum to enter the plasma plume and also the medium to dissolve various ceramic chemical precursors. In both SPS/SPPS, the liquid carrier breaks up on entering the plasma plume to yield a fine droplet size that then yields a fine ceramic projectile size that is directed by the plasma gas motion. SPS/SPPS is desirable over the other methods 1) and 2) because it is possible to use these techniques (SPS/SPPS) to generate a more defined gap/crack structure than the conventional air plasma sprayed vertically cracked structures that will yield lower rub energies generated by method 2). The columnar structures generated by SPS/SPPS have a lower in plane modulus which provides improved damage tolerance. The columnar structures and the columnar coatings are described in detail below.

In an embodiment, as detailed above, the abradable coating is applied onto a substrate such as the hub surface 78 to form the abradable section 80 via a thermal spray method or via a suspension plasma spray (SPS).

In thermal spray methods, melted (or heated) materials are sprayed onto a desired substrate. The "feedstock" (the suspension or solution) is heated by electrical (plasma or arc) or chemical means (combustion flame) and sprayed onto a surface. Thermal spray methods may include plasma spray, flame spray, high velocity oxygen fuel (HVOF), high velocity air fuel (HVAF), or a combination thereof.

In an embodiment, suspension plasma spray (SPS) is a form of plasma spraying where the ceramic feedstock is dispersed in a liquid carrier to form a suspension before being injected into the plasma jet and deposited on a substrate. The plasma jet results in converting the ceramic particles into a stream of molten, semi-molten, or even solid particles that strike the surface of the substrate where the particles undergo rapid deformation and solidification to form the abradable coating.

The method comprises providing a suspension comprising a carrier liquid with solid particles suspended therein, injecting the suspension into a plasma jet of a plasma spray device and directing the plasma jet toward a substrate to deposit a film formed from the particles onto the substrate.

The spray parameters affect certain factors of the coating, such as the size and distribution of porosity, residual stresses, macro and microcracks, factors which have an important influence on the performance and eventual failure of the coating. In an embodiment, the abradable coating formed on the substrate (e.g., the hub surface 78) contains vertical gaps or cracks that provide the coating with strain tolerance when it is subjected to abrasion of the surface from the cantilever stator 76 or due to compression from incursion of the cantilever stator 76.

In other words, the coating formed on the substrate has vertical gaps or cracks that enable the coating to better handle strain in a plane parallel to the coating surface (or in a plane parallel to the surface of the substrate). In an embodiment, the vertical gaps or cracks are substantially perpendicular to the surface of the substrate upon which the coating is disposed. In an embodiment, at least a portion of the gaps or cracks are perpendicular to a free surface of the coating (the free surface being the surface that contacts the atmosphere) or to the surface of the substrate.

While the majority of the cracks or gaps are perpendicular to a surface of the substrate, the cracks may be inclined at an angle of ±45 degrees or less to a perpendicular to the substrate, preferably be inclined at an angle of ±30 degrees or less to a perpendicular to the substrate, be inclined at an angle of ±25 degrees or less to a perpendicular to the substrate, be inclined at an angle of ±15 degrees or less to a perpendicular to the substrate, and more be inclined at an angle of ±10 degrees or less to a perpendicular to the substrate.

While conventional coatings have a porosity of 3 to 15 volume percent, based on total coating volume, the coatings manufactured by the disclosed method has a porosity of 15 to 50 volume percent, preferably 25 to 48 volume percent, and more preferably 30 to 45 volume percent, based on total coating volume. The porosity may be determined by imaging the porous surface at a magnification of 250× using a scanning electron microscope and the using image analysis to determine the porosity. Another method of measuring porosity includes mercury porosimetry. This method involves the intrusion of mercury at high pressure into a material through the use of a porosimeter. The pore size and volume can be determined based on the external pressure needed to force the mercury into a pore against the opposing force of the liquid's surface tension.

The formation of the cracks or gaps in the coating results in the presence of a plurality of column-like structures situated adjacent to one another. These cracks or gaps permit the column-like structures to expand and contract during use (when subjected to strain or stress parallel to the surface of the coating or parallel to a surface of the substrate upon which the coating is disposed). The expansion and contraction of the column-like structures (without undergoing buckling) prevents spalling and provides the abradable coating with an extra measure of strain tolerance when compared with conventional coatings produces by air plasma processes. In other words, the column structure (with the voids and gaps located therebetween) prevents a strain from propagating from one column to adjacent columns across the coating. As a result, the global strain applied to the coating may exceed the local strain capabilities at a point in the coating because these local strains do not get transmitted across the coating. It is desirable for the columnar structure to provide compliance in the coating that in turn limits the in-plane stress in the coating that results from CTE mismatch and thermal gradients.

The coating structure with the cracks and gaps provides the coating with extended life cycle characteristics and reduces the amount of maintenance that needs to be performed on the engine.

In an embodiment, the columns have an average width (measured parallel to the substrate surface) of 20 to 300 micrometers, preferably 50 to 150 micrometers, with a gap or crack average width of 1 to 30 micrometers, preferably 5 to 25 micrometers as measured 125 microns above the interface with the substrate (such as, for example, the hub surface 78). The gaps or cracks separate adjacent columns from one another. The gaps or cracks also provide the columns with a means to accommodate strain induced from the rub with the cantilever stator 76.

In one embodiment, the gaps or cracks can extend throughout the coating thickness. In another embodiment, the gaps or cracks do not extend throughout the coating thickness but extend from a free surface of the coating to a depth of greater than 25% of the coating thickness, preferably to a depth of greater than 50% of the coating thickness, and more preferably to a depth of greater than 75% of the coating thickness.

As noted above, the suspension comprises a carrier liquid with fine solid particles (e.g., the particles of the abradable material that eventually form the coating upon being disposed on a desired substrate). The carrier liquid is preferably one that can either suspend the particles permanently or at least for short period of time during the spray process. The carrier liquid provides the mass to transfer the solid particles into the plasma plume. The carrier liquid evaporates upon contacting the flame leaving the particles to impact the substrate and form the abradable coating.

Surfactants and dispersants that do not disrupt the structure of the abradable coating may optionally be used to suspend smaller particles (e.g., nanoparticles) in the liquid if desired. Waxes and polymers (that are soluble in the liquid) may also optionally be added to the liquid to serve as sacrificial pore formers in the coating if desired.

The liquid used for the suspension may include polar solvents, non-polar solvents, or combinations thereof. The polar solvents may be aprotic solvent, protic solvents, or combinations thereof. Liquid aprotic polar solvents may include water, propylene carbonate, ethylene carbonate, butyrolactone, acetonitrile, benzonitrile, nitromethane, nitrobenzene, sulfolane, dimethylformamide, N-methylpyrrolidone, or the like, or a combination thereof. Polar protic solvents may include alcohols (e.g., methanol, ethanol, butanol, isopropanol, and the like), acetonitrile, nitromethane, or the like, or a combination thereof. Non-polar solvents such a benzene, toluene, methylene chloride, carbon tetrachloride, hexane, diethyl ether, tetrahydrofuran, or the like, or a combination thereof. Ionic liquids including imidazolium salts, may also be used as the carrier liquid if desired.

A preferred solvent for use in the suspension is water or an alcohol. A preferred alcohol is ethanol. The solvent may be used in amounts of 20 to 95, preferably 25 to 90, and more preferably 35 to 80 weight percent (wt %) based on the total weight of the suspension.

The particles used in the suspension for coating cantilever substrates are typically the same chemistry as those used in tribological coatings or thermal barrier coatings in gas turbine engines that are subject to elevated operating temperatures. In an embodiment, the particles used in the suspension include metal oxides including perovskites, zirconate or hafnate base ceramic compounds, zirconate or hafnate based ceramic compounds that have a cubic or tetragonal or tetragonal prime crystal structure, yttria stabilized zirconia (YSZ), cubic zirconia based ceramics such as, for example, gadolinia zirconia. Zr—Ta—Y ternary systems of the cubic, fluorite or orthorhombic crystal structure, or having a combination of the foregoing crystal structures may also be used. Details of some of these particles are provided below.

General examples of metal oxides that may be used as particulates in the suspension comprise silicates, zirconia, titania, alumina, zirconates, titanates, aluminates, stannates, niobates, tantalates, tungstates, and rare earth oxides. The aforementioned metal oxides may be used either singly or in alloys with other metals or metals oxides. In a preferred embodiment, alumina may be used singly while the other metal oxides are used in alloy form.

As noted above, alumina and silicate based materials can also be used as particles in the suspension. The silicates may be based on the mono- and di-silicate systems, for example with ytterbia or yttria as the anion (e.g., $YbSiO_5$, $Yb_2Si_2O_7$, $Y_2SiO_5$, $Y_2Si_2O_7$, or a combination thereof). Other materials such as Halfnon ($HfSiO_4$) may also be used. The alumina base material comprises mullite ($Al_6SiO_{13}$).

Perovskite materials may also be used and have the general structural formula $ABO_3$, where A is Mg, Ca, Sr, Ba, or a combination thereof and B is Al, Mn, Si, Ti, Zr, Co, Ni, Sn, or a combination thereof. Rare earth perovskites may also be used as particulates in the suspension. An example of a rare earth perovskite $La_{(1-x)}A_xCr_{(1-y)}B_yO_3$ where A is Mg, Ca, Sr, Ba, or a combination thereof and B is Al, Mn, Si, Ti, Zr, Co, Ni, Sn, or a combination thereof, with x=0 to 1, preferably 0.05 to 0.8, and more preferably 0.1 to 0.5 and y=0 to 1, preferably 0.05 to 0.8, and more preferably 0.1 to 0.5. Examples of perovskites include $CaTiO_3$, $MgTiO_3$, $CaSiO_3$, $CaSnO_3$, $CaZrO_3$, $MgZrO_3$, $BaZrO_3$, $SrZrO_3$, $BaSnO_3$, $CaSnO_3$, $MgSnO_3$, $SrTiO_3$, or the like, or a combination thereof.

Partially or fully stabilized zirconia or hafnia may also be used as particles in the suspension. The stabilized zirconia may include yttria-, calcia-, magnesia-, ceria-, scandia, lanthanide series elements, hafnia- or alumina-stabilized zirconia or combinations thereof. Fully stabilized zirconia including 20YSZ (yttria-stabilized zirconia containing 20 wt % yttria) and $Gd_2Zr_2O_7$ may be used as particles in the suspension. Other stabilized zirconias such as, for example, FSZ (Fully Stabilized Zirconia), CSZ (Cubic Stabilized Zirconia), 8YSZ (having 8 mole percent $Y_2O_3$ Fully Stabilized $ZrO_2$) and 8YDZ (having 8 to 9 mole percent $Y_2O_3$-doped $ZrO_2$), or combinations thereof, may be used as particles in the suspension. Yttria stabilized zirconia comprising 4 to 9 mole percent of the yttria are preferred, with those having 7 to 9 mole percent more preferred, based on the total number of moles of the yttria stabilized zirconia.

The solid particles generally have an average particle size that ranges from 50 nanometers to 10 micrometers, preferably 100 nanometers to 5 micrometer. The solid particles may be used in amounts of 5 to 80, preferably 10 to 75, and more preferably 20 to 65 wt %, based on the total weight of the suspension. In an exemplary embodiment, the solid particles may be used in amounts of 5 to 20 wt %, based on the total weight of the suspension.

In another embodiment, the particles may not be suspended in a carrier liquid but may co-exist as precursors with the carrier liquid as a solution. In other words, instead of injecting a powder suspended in a carrier liquid into the plasma plume, a particle precursor is used in conjunction with the carrier liquid to produce the abradable coating. This method is sometimes referred to as solution precursor plasma spray and includes injecting a particle precursor solution (hereinafter precursor solution) into the plume of a plasma flame, evaporating solvent from the precursor solution droplets, and pyrolyzing the resulting solid to form the abradable coating. Particles formed during the travel of the solution through the plume impinge on the substrate.

Exemplary precursors include a variety of aluminum and zirconium salts, as long as the counterions therein thermally decompose during the 700-800° C. processing step in a way that does not interfere with the formation of alumina-zirconia. Suitable aluminum salts include aluminum nitrate, aluminum acetate, aluminum chloride, aluminum isopropoxide, aluminum carbonate, aluminum citrate, hydrates of the foregoing salts, and mixtures thereof. In some embodiments, the aluminum salt comprises aluminum nitrate or a hydrate thereof.

Suitable zirconium salts include zirconium nitrate, zirconium acetate, zirconium chloride, zirconium isopropoxide, zirconium carbonate, zirconium citrate, hydrates of the foregoing salts, and mixtures thereof. In some embodiments, the zirconium salt comprises zirconium acetate or a hydrate thereof. In some embodiments, the aluminum salt comprises aluminum nitrate or a hydrate thereof, and the zirconium salt comprises zirconium acetate or a hydrate thereof.

When the abradable coating comprises an alumina-zirconia with a low crystallization temperature, the aqueous solution can comprise the dissolved aluminum salt and the dissolved zirconium salt in amounts sufficient to provide a molar ratio of aluminum to zirconium of about 2.4:1 to about 5.6:1, specifically about 3.0:1 to about 4.6:1. The aqueous solution can contain less than 2 weight percent, specifically less than 1 weigh percent, of components other than water, the dissolved aluminum salt, and the dissolved zirconium salt. In some embodiments, the aqueous solution consists of water, the dissolved aluminum salt, and the dissolved zirconium salt.

A preferred solvent for use in the solution is water or an alcohol. A preferred alcohol is ethanol. The solvent may be used in amounts of 20 to 95, preferably 25 to 90, and more preferably 35 to 80weight percent (wt %) based on the total weight of the solution.

In one embodiment, a suspension may contain particles as well as a particle precursor in a carrier liquid. In other words, the carrier liquid contains particles as well as particle precursors.

In one embodiment, in one method of manufacturing the abradable coating, the carrier liquid is mixed with the solid particles or with the salt precursor in the desired quantity to form the suspension or solution respectively. The suspension or solution is then injected into the plume of a plasma flame at a pressure of 20 to 100 pounds per square inch (psi), preferably 22 to 50 psi and more preferably 30 to 40 psi. The interaction of the suspension or solution with the plasma plume atomizes the carrier liquid to form small individual liquid droplets (with solid particles contained therein).

The coating is generally applied to the substrate under atmospheric pressure conditions, but can be applied at pressures below atmospheric if so desired. In an embodiment, the substrate may have a bond coat applied thereto prior to the deposition of the abradable coating. The substrate temperature during the formation of a typical coating is 300° C. to 1100° C., with a preferred range of 400° C. to 900° C.

In an embodiment, the method disclosed herein may be used to form a gradient coating on the substrate (e.g., the cantilever stator). Gradient coatings may be formed by creating two different feedstocks (e.g., a first feedstock and a second feedstock) having different compositions and by simultaneously or successively varying the feed of the respective feed stocks to the plasma flame. For example, the amount of the first feedstock to the plasma flame can be increased, while at the same time, the amount of the second feedstock to the plasma flame can be reduced.

The abradable coating can also be layered with one or more base layers and one or more top layers. For example, the base layer may include a high toughness material such as YSZ that is provided at the abradable/metallic substrate interface to address maximum strain levels due to thermal expansion mismatch at the abradable/metallic substrate interface. The first abradable layer is primarily utilized to provide high fracture toughness at the ceramic/metal interface where CTE mismatch is greatest and a high toughness material (yttria stabilized zirconia) is desired.

The base layers adjacent to the substrate may be of a single material composition, for example, YSZ or gadolinia zirconate, a multi-material layered composition, for, example, alternating layers of YSZ and gadolinia zirconate, or a mixed material, for example, via the co-deposition of YSZ and gadolinia zirconate.

The abradable coating has a thickness of 5 mils to 50 mils (125 μm to 1250 μm), preferably 15 mils to 30 mils (375 μm to 750 μm).

Figure 3:
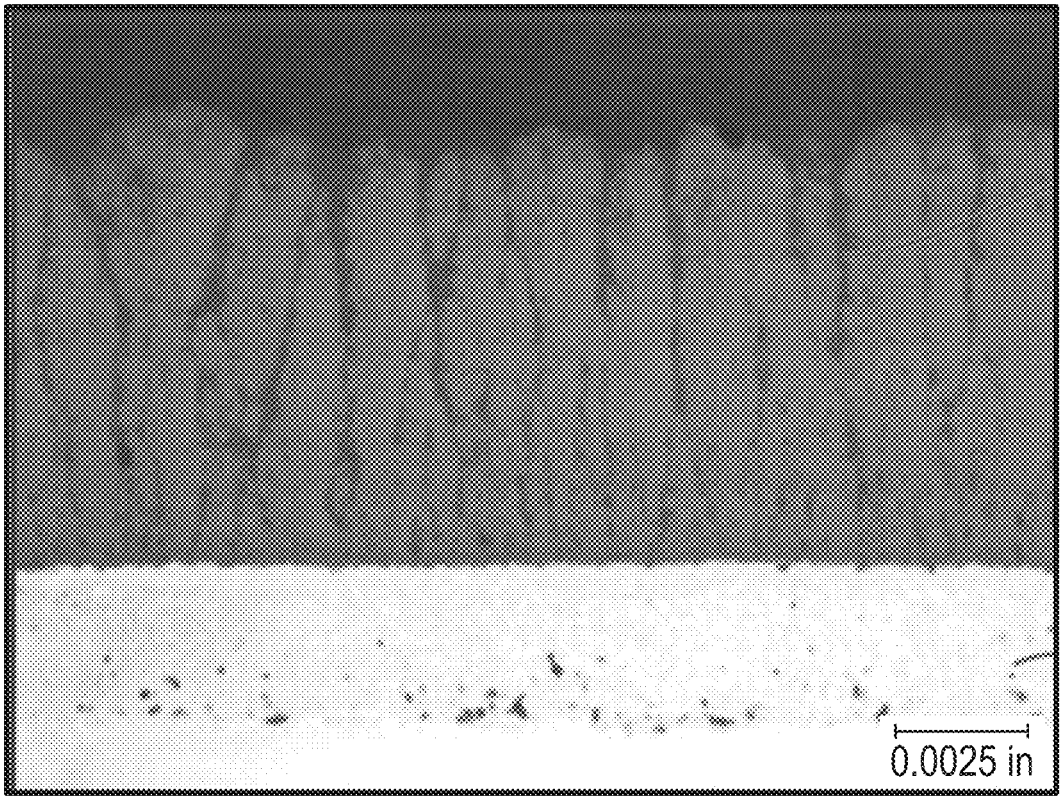
FIG. 3 is a micrograph of an abradable coating disposed on a substrate.

The FIG. 3 depicts a photomicrograph of a YSZ coating with vertical cracks in the coating. These vertical cracks are substantially perpendicular to the substrate surface. The coating has an average adhesive tensile strength of greater than 2000 pounds per square inch (psi), preferably greater than 4000 psi, preferably greater than 6000 psi, and more preferably greater than 8000 psi; when measured as per ASTM C633.

In an embodiment, the abradable coating may be a multilayered coating. The multilayered coating may comprise a first abradable coating upon which is disposed a second abradable coating. The first abradable coating and the second abradable coating may be in direct contact with each other with the first abradable coating also contacting the substrate. The second abradable coating may have a different composition from that of the first abradable coating. In short, the abradable coating can have multiple layers where each layer can have a different composition. In addition, each separate layer may have a gradient in composition.

The first abradable coating is primarily utilized to provide high fracture toughness at the ceramic/metal interface where the coefficient of thermal expansion (CTE) mismatch is greatest. The first abradable coating may therefore be a high toughness material such as yttria stabilized zirconia. The complex oxides listed above are primarily intended for the second abradable coating.

The coating is advantageous in that the vertical cracks and gaps present in the coating provide the coating with a strain tolerance that is significantly greater than that produced in conventional air plasma sprays. As noted above, this provides a longer life cycle for the engine part as well as lower maintenance costs.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

All numerical ranges are inclusive of the endpoints.

It should be appreciated that relative positional terms such as "forward," "aft," "upper," "lower," "above," "below," and the like are with reference to the normal operational attitude of the vehicle and should not be considered otherwise limiting.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An abradable coating disposed on a hub surface of a gas turbine engine, the abradable coating comprising:

a metal oxide; where the first abradable coating comprises a plurality of cracks or voids that are substantially perpendicular to the hub surface or to a free surface of the coating, where the plurality of cracks or voids define a plurality of columns having a width of 20 to 300 micrometers and an average crack width of 5 to 30 micrometers, as measured 125 microns above an interface with the hub surface; wherein the metal oxide comprises a silicate, zirconia, hafnia/hafnate, titania, a zirconate, a titanate, an aluminate, a stannate, a niobate, a tantalate, a tungstate, rare earth oxides, or a combination thereof; and wherein the coating has an adhesive bond strength of greater than 2000 psi when measured as per ASTM C633.

2. The abradable coating of claim 1, where the coating has an adhesive bond strength of greater than 4000 psi when measured as per ASTM C633.

3. The abradable coating of claim 1, where the zirconia comprises yttria stabilized zirconia (YSZ); cubic zirconia; partially or fully stabilized zirconia; zirconia stabilized with yttria, calcia, magnesia, ceria, scandia and lanthanide series elements; hafnia or alumina-stabilized zirconia; fully stabilized zirconia including yttria-stabilized zirconia containing 20 wt % yttria; $Gd_2Zr_2O_7$ fully stabilized zirconia, fully stabilized zirconia containing 8 mole percent yttria, cubic stabilized zirconia, yttria stabilized zirconia having 4 to 9 mole percent yttria; or a combination thereof.

4. The abradable coating of claim 1, where the zirconia comprises one of a partially stabilized zirconia and a cubic zirconia.

5. The abradable coating of claim 1, where the zirconia comprises alumina-zirconia.

6. The abradable coating of claim 1, where the abradable coating comprises multiple layers each having a different composition.

* * * * *